US008561328B2

(12) United States Patent
Wielstra

(10) Patent No.: US 8,561,328 B2
(45) Date of Patent: Oct. 22, 2013

(54) STEAM GENERATING DEVICE PROVIDED WITH A HYDROPHILIC COATING

(75) Inventor: Ytsen Wielstra, Drachten (NL)

(73) Assignee: Koninklijke Philips N.V., Eindhoven (NL)

( * ) Notice: Subject to any disclaimer, the term of this patent is extended or adjusted under 35 U.S.C. 154(b) by 366 days.

(21) Appl. No.: 12/681,116

(22) PCT Filed: Oct. 2, 2008

(86) PCT No.: PCT/IB2008/054019
§ 371 (c)(1),
(2), (4) Date: Apr. 1, 2010

(87) PCT Pub. No.: WO2009/044358
PCT Pub. Date: Apr. 9, 2009

(65) Prior Publication Data

US 2010/0205836 A1 Aug. 19, 2010

(30) Foreign Application Priority Data

Oct. 5, 2007 (EP) ..... 07117929

(51) Int. Cl.
*D06F 75/18* (2006.01)
*D06F 75/24* (2006.01)

(52) U.S. Cl.
USPC ..... 38/77.83

(58) Field of Classification Search
USPC ..... 38/74–77.83, 93; 427/318
See application file for complete search history.

(56) References Cited

U.S. PATENT DOCUMENTS

| | | | | | |
|---|---|---|---|---|---|
| 3,013,901 | A * | 12/1961 | Bugosh | 442/136 |
| 3,499,237 | A | 3/1970 | Piper | |
| 3,551,183 | A * | 12/1970 | Vondracek et al. | 427/318 |
| 3,989,550 | A * | 11/1976 | Newhard | 148/256 |
| 5,060,406 | A | 10/1991 | Verweij et al. | |
| 5,531,796 | A * | 7/1996 | Wasinger et al. | 8/102 |
| 5,837,425 | A * | 11/1998 | Nakanishi et al. | 430/302 |
| 6,638,600 | B2 * | 10/2003 | Gazo et al. | 428/141 |
| 8,453,360 | B2 * | 6/2013 | Wielstra | 38/77.83 |
| 2003/0056407 | A1 | 3/2003 | Boulud et al. | |
| 2011/0236587 | A1 * | 9/2011 | Clark et al. | 427/407.1 |

FOREIGN PATENT DOCUMENTS

| | | | |
|---|---|---|---|
| CN | 1377738 | A | 11/2002 |
| EP | 1146164 | A2 | 10/2001 |
| EP | 1572813 | B1 | 9/2005 |
| FR | 2806427 | A1 | 9/2001 |
| GB | 2077624 | A | 12/1981 |
| JP | 5302174 | A | 11/1993 |
| JP | 2003003282 | A | 1/2003 |
| MX | 02011520 | A | 2/2004 |
| WO | 2004096539 | A1 | 11/2004 |

* cited by examiner

*Primary Examiner* — Ismael Izaguirre

(57) ABSTRACT

A steam generating device includes a steam chamber provided with a hydrophilic coating. The hydrophilic coating includes an acid phosphate compound and boron, such as a salt of boron with a metallic element. T he coating promotes steaming and is resistant to flaking.

20 Claims, 1 Drawing Sheet

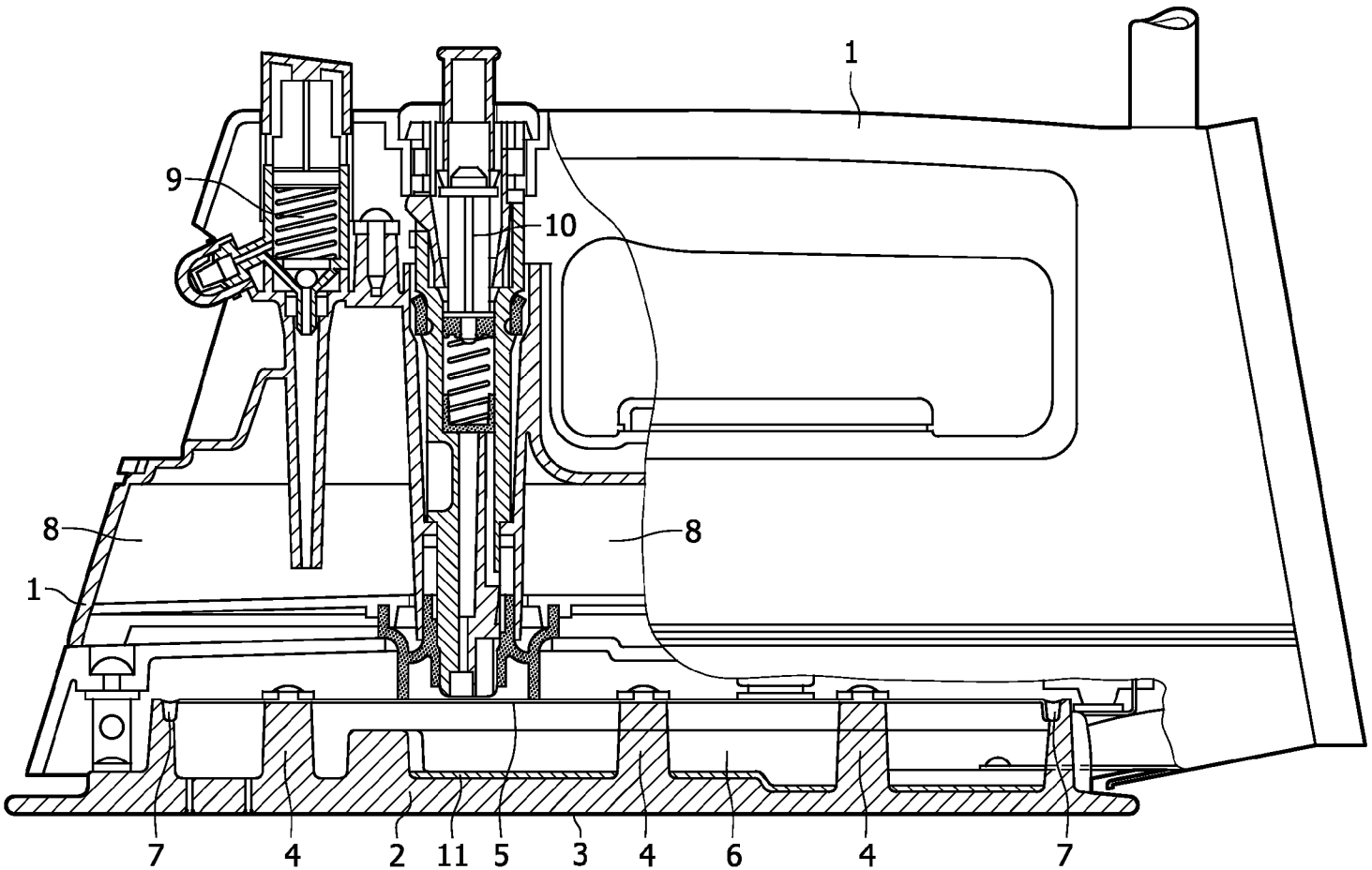
1
10
9
8
8
1
7
4
6
4
3
5
11
2
4
7

STEAM GENERATING DEVICE PROVIDED WITH A HYDROPHILIC COATING

FIELD OF THE INVENTION

The invention relates to a steam generating device comprising a steam chamber provided with a hydrophilic coating. The invention further relates to a method of providing a hydrophilic coating in the steam chamber of a steam generating device. The invention in particular relates to a steam iron comprising a steam chamber provided with a hydrophilic coating.

BACKGROUND OF THE INVENTION

Heating water above 100° C. at 1 atmosphere will transform it into steam. In steam generating devices, such as steam irons, water is applied to a hot surface in order to generate the steam. However, the steam can form an insulating layer between the surface and the water droplets, thereby effectively slowing down the evaporation of water. The water droplets will tend to bounce on the surface instead of evaporating into steam. This effect is called the Leidenfrost effect and generally occurs above 160° C. This effect is for instance observed in steam irons.

Various methods have been proposed to prevent the Leidenfrost effect, ranging from providing special structures in the steam chamber, like ribs for instance, to the use of coatings on the surface of the steam chamber. A suitable steam promoter coating is hydrophilic and moderately heat-insulating. The moderately heat-insulating character of the coating prevents the water from touching the hot aluminum substrate. When some water touches the surface, the surface is immediately cooled down effectively to below Leidenfrost effect temperatures. Preferably also, such steam promoter coatings do have a certain amount of porosity. By virtue of the hydrophilic character of the steam promoter coating, the water introduced spreads readily over the surface of the steam chamber. A suitable steam promoter coating offers a combination of good wetting, absorption of water into the porous structure, and a high surface roughness.

A steam generating device of the type described in the preamble is known from U.S. Pat. No. 5,060,406. The known device (a steam iron) is provided with a steam promoter coating, mainly composed of silica, fillers and an acid phosphate compound, in particular mono aluminum phosphate. Due to the presence of a relatively large amount of fillers, the known coating mixtures are highly viscous and cannot be readily applied by spraying techniques. Mono aluminum phosphate is water-soluble, can be dried and cured into a substantially insoluble inorganic coating, and also acts as acid stabilizer for the colloidal mixtures of silica, used in U.S. Pat. No. 5,060,406. Moreover, it has a low pH and therefore etches the aluminum substrate, which improves the adhesion between the coating and the aluminum substrate. It would therefore be desirable if a steam promoter coating, based largely on mono aluminum phosphates alone, could be applied to the steam chamber surface. However, such coatings are too brittle, and can therefore be applied in small thicknesses only, typically less than one micron. This is not desirable, inter alia, because such small thicknesses increase the risk of occurrence of the Leidenfrost effect.

In summary, the known steam promoter coating does reduce the Leidenfrost effect to the desired level, but is either too viscous or too brittle, in particular, in an environment having a high degree of humidity and a relatively high temperature. This brittleness causes flakes to break away from the steam chamber coating, and said flakes can leave the iron through the steam ports.

SUMMARY OF THE INVENTION

It is an object of the present invention to overcome the above-mentioned problems. For this purpose, it is an object of the invention to provide, in particular, a steam iron which is provided with a steam chamber coating which is less sensitive to internal stresses in a warm and humid environment. A further object is to provide a steam chamber coating which is less sensitive to the Leidenfrost effect. A further object is to provide an inventive method of applying such a steam promoter coating in the steam chamber of a steam iron.

These and other objects are achieved by means of a steam generating device comprising a steam chamber provided with a hydrophilic coating comprising an acid phosphate compound, wherein the coating further comprises boron, and preferably a salt of boron with a metallic element.

BRIEF DESCRIPTION OF THE DRAWINGS

In the drawing:

FIG. 1 is a view partly in cross-section and partly in elevation of a steam iron according to the invention.

DETAILED DESCRIPTION OF EMBODIMENTS

According to the invention, a steam generating device is provided, which device comprises a steam chamber provided with a hydrophilic coating. The hydrophilic coating comprises an acid phosphate compound, as well as boron. In a preferred embodiment, the hydrophilic coating comprises an acid phosphate compound, as well as a salt of boron with a metallic element. The combined use of an acid phosphate compound and boron, and preferably a salt of boron with a metallic element, yields a coating which, after curing, has an excellent steaming performance. In particular, the invented coating shows most of the desirable features of a steam promoter coating: it not only shifts the Leidenfrost effect to higher temperatures, it also shows a good wetting behavior and good water spreading into the porous structure.

A further advantage of the coating according to the invention is that the amount of filler in the coating can be lower than in the coating known hitherto. Filling a coating with particles may improve the steaming properties but also increases the viscosity of the uncured coating. This may lead to difficult application of the coating, and the preferred method of spraying may not be applicable. The coating of the invention is easily sprayable.

In a preferred embodiment of the invention, the steam generating device is characterized in that the metallic element is an alkali metal element. Any alkali metal element may in principle be used, but preferred elements are chosen from the group of sodium, lithium and potassium. The use of lithium is particularly preferred if the stability of the steam promoter coating composition has to be improved. Moreover it has been established that the use of lithium also improves the strength of the steam promoter coating.

According to the invention, the hydrophilic steam chamber coating comprises an acid phosphate compound. This is to be understood to mean a metal-phosphate compound in which the phosphate is at least singly protonated ($HPO_4^{2}$— or $H_2PO_4$—). Examples of suitable compounds are $MgHPO_4$ and $Zn(H_2PO_4)_2$. The acid phosphate compound in the steam chamber coating provides a good adhesion with the aluminum substrate.

It has been demonstrated that in this respect aluminum phosphate compounds, more particularly aluminum triphosphate ($Al(H_2PO_4)_3$), can be employed very advantageously. These compounds can be used with additional fillers in the steam chamber coating in which they then serve as binders. It has been found that the presence of aluminum phosphate in the steam chamber coating ensures that such a coating is particularly insoluble in water.

In order to produce a favorable effect, the quantity of borate in the steam promoter coating is preferably between 1 and 40% by weight of the total composition of the dried coating (the water in the coating composition being substantially removed). More preferably, the quantity of borate is between 5 and 30% by weight, most preferably between 8 and 20% by weight.

The mechanical properties and in particular the strength of the coating can be improved by adding fillers thereto. Any filler known in the art may be employed, including metal oxide particles, such as alumina or silica, and mineral particles, such as mica, kaolin, etc. In a further preferred embodiment of the invention, the hydrophilic coating of the steam generating device comprises alumina particles. These particles are believed to yield better coatings as they can scavenge any excess phosphoric acid present in commercially available aluminum phosphate solutions.

In order to produce coatings with improved mechanical properties, the quantity of filler in the steam promoter coating is preferably between 5 and 60% by weight of the total composition of the dried coating (the water in the coating composition being substantially removed). More preferably, the quantity of filler is between 10 and 40% by weight, most preferably between 15 and 25% by weight. The performance of the coating can be optimised by adding additional metal oxides to the coating solution.

The invention also relates to a method of producing a hydrophilic coating in the steam chamber of a steam generating device. The method comprises preparing a mixture of an acid phosphate compound and a salt of boron with a metallic element, introducing the mixture into the steam chamber and curing the mixture at an elevated temperature to form a hydrophilic coating. Introducing the mixture into the steam chamber is preferably carried out by spraying.

In particular, the method is characterized in that boric acid is dissolved in water to which an alkali metal hydroxide is added. Suitable metal hydroxides are sodium hydroxide, lithium hydroxide and potassium hydroxide, lithium hydroxide being the most preferred alkaline compound. This solution (or slurry) is then stirred into a solution of an acid phosphate compound. The resulting (translucent) solution, usually having an increased viscosity, is then applied to the aluminum substrate and cured at an elevated temperature into a hydrophilic steam chamber coating. A substantially insoluble, porous aluminum borophosphate coating is obtained. The obtained coating promotes the formation of steam, without the occurrence of flaking and/or other disadvantageous effects.

An additional advantage of the coating according to the invention is that suitable coatings can be obtained within a wide range of thicknesses. Due to the favorable rheology of the coating composition of the invention, and in particular its relatively low viscosity, rather thin coatings can readily be applied. The coating layer thickness can thus be tuned, depending on the specific type of steam promoter material used. Thick, non-porous coating layers will prevent the Leidenfrost effect up to high temperatures. However, if the layer is too thick, the thermal conduction through the layer limits the evaporation rate too much. Especially at lower temperatures and high dosing rates, water can leak out of the steam generating device. If the coating layer is too thin, the evaporation rates at low temperatures are higher. However, the steam generating device will in this case be more prone to the Leidenfrost effect, and water touching the surface can bounce off, leading to spitting of the steam generating device at high temperatures. For porous coating layers, high evaporation rates both at low temperatures (due to better spreading) and at high temperatures can be achieved. The layer thickness moreover may be limited by the mechanical properties of the coating material. Flaking may occur if coating layers exceed a certain critical thickness. Generally speaking, preferable coating layer thicknesses vary between 1 and 100 micron, more preferably between 20 and 80 micron, and most preferably between 30 and 60 micron.

To improve the adhesion between the coating and the aluminum substrate, the aluminum can be cleaned by rinsing with organic solvent and/or by mechanical means, such as by sandblasting. Wetting of the aluminum surface can also be improved by adding surfactants to the coating mixture.

Curing of the mixture is performed at an elevated temperature, the specific curing temperature being dependent on the composition of the coating. The uncured coating can be brought to the curing temperature by heating in an oven, or by any other heating source, such as infrared, ultrasonic, etc. The preferred method of curing however comprises heating the steam chamber surface itself. In this way the coating is cured from the inside to the outside surface thereof, which has a beneficial effect on the properties of the produced coating. The inside surface is the surface closest to the aluminum substrate, the outside surface being the surface most remote from the aluminum substrate. Too fast drying/curing of the coating composition may result in boiling marks in the cured coating. It therefore is preferred to preheat the soleplate before application of the coating composition.

The invention will now be explained in greater detail by means of the enclosed figure, and by means of the following examples, without however being limited thereto.

The steam iron shown in FIG. 1 is composed of a housing 1 which is closed on the bottom side by an aluminum soleplate 2 which is provided with a thin layer of stainless steel on the underside 3. The soleplate is provided with upright ribs 4 on the inside, on which ribs an aluminum plate 5 is provided in such a manner that a steam chamber 6 is formed between the inside of the soleplate 2 and the plate 5. The steam chamber 6 is sealed by an elastic silicone rubber 7. The steam iron further comprises a water reservoir 8. By means of a pumping mechanism 9, water from the reservoir 8 can be sprayed directly onto the clothes to be ironed. By means of a pumping mechanism 10, water can be pumped from the reservoir 8 into the steam chamber 6, thus increasing the steam output. This water passes through an aperture in plate 5 to the bottom of the steam chamber 6. The bottom of the steam chamber 6 is provided with a hydrophilic steam chamber coating 11. The hydrophilic coating 11 is manufactured and provided as described in the following examples.

In all examples an aqueous suspension was made of the indicated ingredients by simple mixing. The suspensions thus obtained were subsequently applied to the bottom of the steam chamber 6 and then thickened. In this manner a hydrophilic steam chamber coating 11 (FIG. 1) is obtained. The adherence to the aluminum bottom of the steam chamber 6 is enhanced because the acid $H_2PO_4^{2-}$ ions react with metals and oxides until stable, insoluble compounds are formed which no longer react with water. In mono aluminum phosphate (MAP), the ratio of Al to P is 1:3. Commercially available MAP may differ in the amount of phosphoric acid present and hence in the Al to P ratio. In the examples, commercially available MAP from Sigma-Aldrich was used as a technical grade from Alfa Aesar.

EXAMPLE I

Influence of the Amount of Boron

In this set of experiments, the influence of the amount of boron on the intrinsic insolubility and resistance to steaming of MAP was analysed. Varying amounts of boric acid were dissolved in MAP, as indicated in Table 1. With increasing boric acid content, an increasing amount of additional water was needed to dissolve the boric acid in the MAP. Already at relatively low amounts of boron the benefits according to the invention were observed. Pure MAP when applied on an aluminium soleplate and cured at 220° C. showed degradation of the coating layer. In contrast, no disintegration or dissolution of the boron modified MAP was observed for all boron contents.

TABLE 1

Prepared solutions and results

| MAP | boric acid | Water | Al | P | B | Disintegration |
|---|---|---|---|---|---|---|
| 20 gram | 0 gram | — | 1 | 3 | — | Yes |
| 20 gram | 0.5 gram | 15 | 1 | 3 | 0.25 | No |
| 20 gram | 1 gram | 15 | 1 | 3 | 0.5 | No |
| 20 gram | 1.5 gram | 15 | 1 | 3 | 0.75 | No |
| 20 gram | 2.0 gram | 30 | 1 | 3 | 1 | No |

EXAMPLE II

Influence of the Amount of Alkali

In this set of experiments, the influence of the amount of alkali on the solubility of the coating was analysed. As the solubility of boric acid in MAP is limited, additional alkali was used to pre-dissolve the boric acid and to add the resulting solution to the MAP, hence the amount of additional water to dissolve the boric acid is lowered and preparation times are shortened. In the experiments, 2 grams of boric acid were mixed with a certain quantity of alkali hydroxide (as indicated in Tables 2 and 3) in 8 grams of water. The boric acid dissolved. In some cases the resulting borate precipitated again. The resulting solution or slurry was added to 20 grams of MAP. It was observed that some gel particles may form, but these dissolve again while stirring. At higher amounts of alkali a gel was formed. The coating solution was applied into the steam chamber of a steam iron and cured at 220° C. Dissolution of the coating was tested at 220° C. with dripping water and verified visually.

In the case of LiOH (Tables 2 and 3), a clear range that could be added was observed. The experiments were carried out by mixing 20 grams of MAP with a solution of 2 grams of boric acid and 0.4 grams of $LiOH.H_2O$ in 8 grams of water. The resulting mixture was slightly cloudy and of low viscosity. Application into a steam chamber and subsequent drying at 220° C. resulted in good steaming. Below 0.4 gram the boric acid did not dissolve in the water. Above 1 gram, the MAP started to gel when the borate was added. It is known that MAP is sensitive to variations in pH. In general, adding a base to MAP will result in precipitation of MAP. The amount of alkali that can be added is dependent on the amount of free phosphoric acid present in the MAP. In this case it was observed that the used technical grade of MAP could take a higher amount of LiOH, presumably due to the presence of larger amounts of phosphoric acid. In general it is preferred to use as little alkali as possible for pre-dissolving the boric acid.

TABLE 2

Prepared solutions and results

| MAP (Aldrich) | B | $LiOH•H_2O$ | Al | B | Li | MAP/B | Dissolution |
|---|---|---|---|---|---|---|---|
| 20 | 2 | 0.39 | 1 | 1.03 | 0.30 | + | + |
| 20 | 2 | 0.62 | 1 | 1.03 | 0.47 | + | + |
| 20 | 2 | 0.80 | 1 | 1.03 | 0.61 | + | + |
| 20 | 2 | 1.00 | 1 | 1.03 | 0.76 | Gel | NA |
| 20 | 2 | 1.20 | 1 | 1.03 | 0.91 | Gel | NA |

TABLE 3

Prepared solutions and results

| MAP (Tech) | B | $LiOH•H_2O$ | Al | B | Li | MAP/B | Dissolution |
|---|---|---|---|---|---|---|---|
| 20 | 2 | 0.39 | 1 | 1.03 | 0.30 | + | + |
| 20 | 2 | 0.59 | 1 | 1.03 | 0.45 | + | + |
| 20 | 2 | 0.82 | 1 | 1.03 | 0.62 | + | + |
| 20 | 2 | 1.02 | 1 | 1.03 | 0.77 | + | + |
| 20 | 2 | 1.20 | 1 | 1.03 | 0.91 | + | + |
| 20 | 2 | 1.45 | 1 | 1.03 | 1.10 | Gel | NA |

When adding NaOH instead of LiOH (Table 4), similar results were found although the range was more limited. In these experiments, 2 grams of $BOH_3$ were dissolved in 8 grams of water with 0.4 grams of NaOH. The solution was stirred into 20 grams of MAP (50%). The resulting mixture (Al:P:B:Na=1:3:1:0.31) was applied into a steam chamber and dried at 220° C. by direct heating of the soleplate. Good steaming was observed with no flaking or coating degradation.

TABLE 4

Prepared solutions and results

| MAP (Aldrich) | B | NaOH | Al | B | Na | MAP/B | Dissolution |
|---|---|---|---|---|---|---|---|
| 20 | 2 | 0.2 | 1 | 1.03 | 0.16 | NA | NA |
| 20 | 2 | 0.4 | 1 | 1.03 | 0.32 | + | + |
| 20 | 2 | 0.6 | 1 | 1.03 | 0.48 | – | NA |
| 20 | 2 | 0.8 | 1 | 1.03 | 0.64 | – | NA |
| 20 | 2 | 1.0 | 1 | 1.03 | 0.79 | – | NA |

TABLE 5

Prepared solutions and results

| MAP (Tech) | B | NaOH | Al | B | Na | MAP/B | Dissolution |
|---|---|---|---|---|---|---|---|
| 20 | 2 | 0.2 | 1 | 1.03 | 0.16 | Na | Na |
| 20 | 2 | 0.4 | 1 | 1.03 | 0.32 | + | + |
| 20 | 2 | 0.6 | 1 | 1.03 | 0.48 | + | + |
| 20 | 2 | 0.8 | 1 | 1.03 | 0.64 | + | + |
| 20 | 2 | 1.0 | 1 | 1.03 | 0.79 | + | + |
| 20 | 2 | 1.2 | 1 | 1.03 | 0.95 | + | + |
| 20 | 2 | 1.4 | 1 | 1.03 | 1.11 | Gel | NA |

In case potassium hydroxide is added to the solution (Tables 6 and 7), the sensitivity to gelation was too high to get workable solutions. With an equimolar amount of KOH, the borate precipitates. The precipitated borate was added to the MAP, forming some jelly particles that slowly dissolved again. The strength of the resulting layer was less than that of the lithium-modified aluminum borophosphate. Below 1 gram of KOH the boric acid did not dissolve fully. Above that, the MAP showed gelation upon addition of the borate.

TABLE 6

| Prepared solutions and results | | | | | | | |
|---|---|---|---|---|---|---|---|
| MAP (Aldrich) | B | KOH | Al | B | K | MAP/B | Dissolution |
| 20 | 2 | 0.19 | 1 | 1.03 | 0.11 | NA | NA |
| 20 | 2 | 0.41 | 1 | 1.03 | 0.23 | NA | NA |
| 20 | 2 | 0.60 | 1 | 1.03 | 0.34 | NA | NA |
| 20 | 2 | 0.77 | 1 | 1.03 | 0.44 | NA | NA |
| 20 | 2 | 1.00 | 1 | 1.03 | 0.57 | Gel | NA |
| 20 | 2 | 1.23 | 1 | 1.03 | 0.70 | Gel | NA |
| 20 | 2 | 1.39 | 1 | 1.03 | 0.79 | Gel | NA |
| 20 | 2 | 1.60 | 1 | 1.03 | 0.91 | Gel | NA |

TABLE 7

| Prepared solutions and results | | | | | | | |
|---|---|---|---|---|---|---|---|
| MAP (Tech) | B | KOH | Al | B | K | MAP/B | Dissolution |
| 20 | 2 | 1.00 | 1 | 1.03 | 0.57 | Gel | NA |
| 20 | 2 | 1.23 | 1 | 1.03 | 0.70 | Gel | NA |
| 20 | 2 | 1.39 | 1 | 1.03 | 0.79 | Gel | NA |

According to the invention, the amount of boric acid that can be added is not limited to a ratio of Al to B of 1:1. Addition of larger amounts of boric acid is possible but leads to a need for larger amounts of alkali to get the boric acid dissolved in a practical way.

EXAMPLE III

Influence of Fillers

A further increase of the mechanical strength can be achieved by filling the borophosphate mixtures with e.g silica or alumina. Also other fillers can be employed according to general practice in the coating industry. Addition of fillers is also beneficial for improvement of the steaming behaviour of the coating layer as applied. In these experiments colloidal silica has been used. They are commercially available e.g. under the trade name Ludox or Bindzil. For compatibility reasons it is preferred that the silica is positively charged. An example is Ludox-Cl, a silica with a surface, modified with aluminium atoms. Addition of e.g. Ludox AS40, which is negatively charged silica, generally is less beneficial.

In an example, 20 grams of MAP was mixed with a solution of 2 grams of boric acid and 0.4 grams of $LiOH.H_2O$ in 8 grams of water. The resulting mixture was slightly cloudy and of low viscosity. 4 grams of Ludox-Cl was slowly added while stirring, thus increasing the viscosity somewhat. Application into a steam chamber and subsequent drying at 220° C. resulted in a coating with good steaming properties and improved mechanical strength.

In a comparative example, 4 grams of Ludox-CL was added to 20 grams of MAP. The translucent solution was added to a steam chamber and subsequently cured by direct heating of the soleplate. The integrity of the coating appeared to be poor as was the steaming performance.

Coarser silicas, like Syloid C809 (Grace) or alumina Alu-C from Degussa can also be used to advantage. In an example, 20 grams of MAP was mixed with a solution of 2 grams of boric acid and 0.4 grams of $LiOH.H_2O$ in 8 grams of water. The resulting mixture was slightly cloudy and of low viscosity. Addition of a dispersion of 2.8 grams of Syloid C809 in 15 grams of water results in a translucent solution. Application into a steam chamber and subsequent drying at 220° C. resulted in a coating with good steaming properties and improved mechanical strength.

In a comparative example, 2.8 grams of Syloid C809 (easy dispersible silica from Grace) were dispersed into 15 grams of water. The dispersion was added to 20 grams of a 50% solution of MAP in water. The low-viscosity material was applied into a steam chamber and cured by direct heating of the soleplate. The material showed flaking during steaming.

In another example according to the invention, an amount of 20 grams of MAP was mixed with a solution of 2 grams of boric acid and 0.4 grams of $LiOH.H_2O$ in 8 grams of water. The resulting mixture was slightly cloudy and had a relatively low viscosity. To this mixture 9.7 grams of Aerodisp W630 (alumina dispersion in water from Degussa) was slowly added while stirring. Application of the coating composition into a steam chamber and subsequent drying at 220° C. resulted in a coating exhibiting good steaming behavior and good mechanical strength.

Addition of hydrolysed silanes can also be used to increase mechanical strength. Tetra ethoxysilane (TEOS) for example can be hydrolysed with water under acidic conditions, forming formally $Si(OH)_4$. Addition to the aluminium borophosphate in small amounts increases the mechanical strength. Larger amounts may cause gelation of the coating material.

In an example, 20 grams of MAP were mixed with a solution of 2 grams of boric acid and 0.4 grams of NaOH in 8 grams of water. An amount of 1.6 grams of TEOS, 1.8 grams of alcohol, 0.82 grams of $H_2O$ and 0.014 grams of maleic acid were mixed and left for 30 minutes to complete hydrolysis. The hydrolyzed mixture was stirred into the borophosphate, causing precipitation (relative amounts of Al:P:B:Na:Si=1:3:1:0.31:0.25). Adding only half of the amount of hydrolysed TEOS gave some turbidity in the solution. Table 8 shows the influence of the amount of TEOS (Si) on properties.

TABLE 8

| Prepared solutions and results | | | | | | | |
|---|---|---|---|---|---|---|---|
| Al | P | B | Na | Si | Solution | Steam. | Coating |
| 1 | 3 | 1 | 0.31 | 0.06 | Translucent | + | Improved integrity |
| 1 | 3 | 1 | 0.31 | 0.12 | Viscous (turbid) | + | Improved integrity |
| 1 | 3 | 1 | 0.31 | 0.25 | Precipitation | | |

The coating compositions according to the invention can also be used for system irons having a separate steam chamber connected to the iron by a hose.

The invention relates to a steam generating device, comprising a steam chamber provided with a hydrophilic coating. The hydrophilic coating comprises an acid phosphate compound and boron, preferably a salt of boron with a metallic element. The coating promotes steaming and is resistant to flaking. The invention also relates to a method of producing the hydrophilic coating in the steam chamber of a steam generating device, and to an iron comprising the steam generating device.

The invention claimed is:

1. A steam generating device comprising:

a steam chamber; and a hydrophilic coating located on a surface of the steam chamber, the hydrophilic coating comprising an acid phosphate compound, boron, and $Al(H_2 PO_4)_3$.

2. The steam generating device, according to claim 1, wherein the coating comprises a salt of boron with a metallic element.

3. The steam generating device according to claim 2, wherein the metallic element is an alkali metal element.

4. The steam generating device according to claim 3, wherein the alkali metal element is lithium and/or sodium.

5. The steam generating device of claim 2, wherein a quantity of the salt of boron with the metallic element in the hydrophilic coating is between 1 and 40% by weight of a total composition of the hydrophilic coating.

6. The steam generating device of claim 2, wherein a quantity of the salt of boron with the metallic element in the hydrophilic coating is between 5 and 30% by weight of a total composition of the hydrophilic coating.

7. The steam generating device of claim 2, wherein a quantity of the salt of boron with the metallic element in the hydrophilic coating is between 8 and 20% by weight of a total composition of the hydrophilic coating.

8. The steam generating device of claim 2, wherein a quantity of the salt of boron with the metallic element in the hydrophilic coating is between 8 and 20% by weight of a total composition of the hydrophilic coating.

9. A steam generating device comprising:

a steam chamber; and a hydrophilic coating located on a surface of the steam chamber, the hydrophilic coating comprising an acid phosphate compound and boron, wherein a quantity of a salt of boron with a metallic element in the hydrophilic coating is between 1 and 40% by weight of a total composition of the hydrophilic coating.

10. The steam generating device according to claim 1, wherein the hydrophilic coating comprises silica particles.

11. The steam generating device according to claim 1, wherein the hydrophilic coating comprises alumina particles.

12. A steam iron comprising a steam generating device according to claim 1.

13. The steam generating device of claim 1, wherein the hydrophilic coating composition comprises Al:P:B:Na in a ratio by weight of 1:3:1:0.31.

14. The steam generating device of claim 1, wherein the hydrophilic coating composition comprises approximately equal amounts of Al and B.

15. The steam generating device of claim 1, wherein the acid phosphate compound includes a metal-phosphate compound in which the phosphate is singly protonated.

16. The steam generating device of claim 1, wherein the acid phosphate compound phosphate comprises one of $MgHPO_4$ and $Zn(H_2PO_4)_2$.

17. A method of producing a hydrophilic coating in a steam chamber of a steam generating device, the method comprising the acts of:

preparing a mixture of an acid phosphate compound, boron and $Al(H_2 PO_4)_3$;

introducing the mixture into the steam chamber; and curing the mixture at an elevated temperature to form a hydrophilic coating.

18. The method according to claim 17, wherein the mixture is brought to the elevated temperature by heating the steam chamber surface.

19. The method of claim 17, wherein the coating comprises a salt of boron with a metallic element.

20. The method of claim 19, wherein a quantity of the salt of boron with a metallic element in the steam promoter coating is between 1 and 40% by weight of a total composition of the hydrophilic coating.

* * * * *